US005925415A

United States Patent [19]

Fry et al.

[11] Patent Number: 5,925,415

[45] Date of Patent: Jul. 20, 1999

[54] ELECTROLESS PLATING OF A METAL LAYER ON AN ACTIVATED SUBSTRATE

[75] Inventors: James L. Fry; Stefan Uhlenbrock; Rita J. Klein, all of Toledo, Ohio

[73] Assignee: The University of Toledo, Toledo, Ohio

[21] Appl. No.: 09/036,814

[22] Filed: Mar. 9, 1998

Related U.S. Application Data

[63] Continuation of application No. 08/658,350, Jun. 5, 1996, abandoned.

[51] Int. Cl.[6] ..... B05D 5/12

[52] U.S. Cl. ..... 427/304; 427/306; 427/443.1

[58] Field of Search ..... 427/304, 98, 299, 427/305, 306, 443.1; 106/1.05, 1.22

[56] References Cited

U.S. PATENT DOCUMENTS

| | | | |
|---|---|---|---|
| 4,080,284 | 3/1978 | Mitchell | 208/111 |
| 4,545,850 | 10/1985 | Nelson | 156/642 |
| 4,648,975 | 3/1987 | Barkatt et al. | 210/656 |
| 5,017,540 | 5/1991 | Sandoval et al. | 502/158 |
| 5,079,600 | 1/1992 | Schnur et al. | 357/4 |
| 5,269,838 | 12/1993 | Inoue et al. | 106/1.22 |
| 5,281,440 | 1/1994 | Fry et al. | 427/299 |

OTHER PUBLICATIONS

JJ Reed–Mundell et al., "Formation of New Materials with thin Metal Layers through "Directed" Reduction of Ions at surface–Immobilized Silyl Hydride Functional Groups", American Chemical Society, pp. 1655–1660, 1995.

Kol'tsov, S.I., Aleskovaskii, V.B., "The Effect of the Degree of Silica Gel," Rus. J. Chem., Mar. 1967, 41, 336–7.

Durgesh V. Nadkarni et al., Demonstration of a Novel Method for the Controlled Deposition of Metals Onto Surfaces by Preparation of a Pd–Hg/Si02 Catalyst for the Selective Hydrogenation of Alkynes to Alkenes, J. Chem. Soc., Chem. Commun., No month available 1993, 997–998.

Budkevich, I.D. et al., "Reduction Properties of Hydride-polysiloxane Xerogel," Kolloidn, Zh., 28(1), 21–6 (Russ) no month available 1966.

Walter J. Dressick et al., Covalent Binding of Pd Catalysts to Ligating Self–Assembled Monolayer Films for Selective Electroless Metal Deposition, J. Electrochem, Soc., vol. 141, No. 1, Jan. 1994, 210–220.

J.J. Reed–Mundell et al., Formation of New Materials With Thin Metal Layers Through "Directed" Reduction of Ions at Surface–Immobiized Silyl Hydride Functional Groups. Silver on Silica, Chemistry of Materials, Sep. 7, 1995, 1655–1660.

*Primary Examiner*—Brian K. Talbot

*Attorney, Agent, or Firm*—MacMillan Sobanski & Todd, LLC

[57] ABSTRACT

A method of electroless plating at least one homogeneous metal coating in a predetermined pattern on a solid substrate surface having pendant hydroxy groups. The method includes the steps of providing a first monatomic metal layer in a predetermined pattern on the solid substrate surface having pendent hydroxy groups and then immersing the solid substrate surface in a bath containing a chemical reducing agent to build up the at least one homogeneous metal coating only on the monatomic metal layer.

15 Claims, No Drawings

ELECTROLESS PLATING OF A METAL LAYER ON AN ACTIVATED SUBSTRATE

REFERENCE TO RELATED APPLICATION

This application is a continuation of U.S. application Ser. No. 08/658,350, filed Jun. 5, 1996 now abandoned, the entire disclosure of which is incorporated herein by reference.

FIELD OF THE INVENTION

The present invention relates to a method of electroless plating of a metal layer on an activated substrate. The present invention also relates to a method of activating a substrate for electroless plating of one or more homogeneous metal layers on the substrate and the product produced thereby.

BACKGROUND OF THE INVENTION

Electroless plating on different substrates is a very important process in areas such as surface coating and electronics fabrication. Nevertheless, the reaction is not yet fully understood.

In general, electroless plating is the deposition of a metal coating by immersion of a substrate in a suitable bath containing a chemical reducing agent. The metal ions are reduced by the chemical reducing agent in the plating solution and deposit on the substrate to a desired thickness. The electroless plating process once initiated is an autocatalytic redox process. The process resembles electroplating in that the plating process may be run continuously to build up a thick metal coating on the substrate except no outside current is needed.

Usually the plating process is initiated by first treating the substrate with a colloidal suspension of Pd and Sn species which are functioning as the initial catalyst. Thereby the tin(II) is acting as an antioxidant and protective layer that keeps the palladium, which is the actual catalyst, in the low-valent state required for the initiation of the plating. However, the use of the Pd/Sn systems is relatively difficult and it does not adhere to surfaces with high levels of free Si-OH moieties like glass, silica gel or clean silica.

In addition to the problem of activating the substrate surface, the ranges of the concentrations that yield stable plating baths with practicable rates of electroless deposition are limited. Electroless deposition suffers from the disadvantage of being unstable and sensitive to impurities and the like at heretofore known plating bath concentrations. Accordingly, it would be advantageous to the electroless plating process to improve the overall stability of the process and maintain an acceptable rate of electroless deposition.

It will be appreciated from the foregoing that there is a significant need for an improved electroless plating process and improved methods of activating the substrate.

Accordingly, it is an object of the present invention to provide an electroless plating process having improved stability. Another object is to provide an electroless plating process having lower plating bath concentrations to improve the stability of the electroless plating process and acceptable rates of electroless deposition, about 0.2 $\mu$m/hour or higher. It is another object of the present invention to provide a method of depositing a monatomic film on either a metal or nonmetal substrate surface including glass and plastic and the like to activate the substrate for further electroless plating. Another object of the present invention is to provide a method of depositing a monatomic film on either a metal or nonmetal substrate surface that is simple and economical. Another object of the present invention is to provide a method of activating a substrate surface that does not include pyridine thereby making the reaction more facile and much safer for humans and the environment. Yet another object of the present invention is to provide a method of activating a substrate surface by increasing the yield of SiH groups per gram of substrate.

Yet another object of the present invention is to provide a method for the quantitative determination of silyl hydrides on the surface of the substrate that is more accurate and more time efficient than previous precipitation methods due to the higher accuracy of the ICP (Inductively Coupled Plasma) analysis.

SUMMARY OF THE INVENTION

Briefly, in accordance with the present invention there is provided a method of electroless plating a homogeneous metal coating in a predetermined pattern on a solid substrate surface having pendant hydroxy groups. The method includes the steps of providing a first monatomic metal layer in a predetermined pattern on the solid substrate surface having pendant hydroxy groups and then immersing the solid substrate surface in a bath containing a chemical reducing agent to build up one or more homogeneous metal coatings only on the monatomic metal layer.

The monatomic metal layer is formed in a predetermined pattern on the solid substrate surface by reacting a hydroxy group of the solid surface with a silyl hydride. The silyl hydride groups of the solid surface are then reacted with a metal salt solution containing an amount of metal sufficient to react with a desired amount of silyl hydride groups to reduce metal ions in solution to a valence of zero to deposit metal on the surface of the substrate.

The electroless plated metal layer substrate may find application in fields such as optical devices, microcircuitry, and as surface deposited catalysts.

DESCRIPTION OF THE PREFERRED EMBODIMENTS

In accordance with the present invention, a method is provided for selectively depositing a homogeneous metal coating on an activated substrate surface having pendant hydroxy groups. The method includes providing a first monatomic metal layer in a predetermined pattern on the activated solid substrate surface having pendant hydroxy groups and then immersing the solid substrate surface in a bath containing a chemical reducing agent to build up at least one homogeneous metal coating only on the monatomic metal layer.

The substrate surface may be of any suitable metal or nonmetal surface as desired having pendant hydroxy groups. The pendant hydroxy groups may be either preexisting or created on the substrate surface as well known in the art. In a preferred embodiment, the substrate surface is a solid surface of glass, silica, silica gel, titania, alumina, cellulose, ceramics, metal oxides, zeolites or alkaline earth metal oxides and the like having pendant hydroxy groups.

The substrate surface is activated for electroless deposition by covalently bonding a first monatomic metal layer on the substrate surface. It will be appreciated that when the first monatomic metal layer is deposited on the substrate thereby activating the substrate, the direct growth of metal layers by electroless plating is facilitated, e.g., without contamination by intervening organic residues thereby providing excellent metal to metal adhesion.

The first monatomic metal layer may be of any suitable metal such as a transition metal selected from Group VIIIB and IB and the like. In a preferred embodiment, the first monatomic metal layer is selected from silver, gold, mercury, lead, uranium, palladium, platinum, copper, bismuth, osmium, ruthenium, antimony and tin and the like.

The first monatomic metal layer is bonded on the substrate surface by reacting hydroxy groups of the substrate surface with a silyl hydride followed by immersion in a suitable metal ion solution. The silyl hydride may be dichlorosilane or trichlorosilane or other reactive silohydrides.

In a preferred embodiment, the hydroxy groups of the substrate surface are reacted with a silyl hydride in an inert atmosphere free from moisture to obtain substantially higher yields. More particularly, the hydroxy groups of the substrate surface are reacted with a silyl hydride using inert-atmosphere techniques as well known in the art.

For example, a reactor system including a three necked flask having an addition funnel, gas inlet, Dewar condenser and mechanical stirrer may be used. The reactor system may be oven dried and assembled immediately after removal from the oven under an inert atmosphere to provide a closed, moisture free reactor. The reactor system allows for the evacuation and treatment of the substrates with silyl hydride under inert conditions. Dry solvents and reactants may be added to the reactor system using double pointed stainless steel needles and cannula techniques. For a more detailed discussion of inert-atmosphere techniques reference is made to "The Manipulation of Air-Sensitive Compounds" by D. F. Shriver and M. A. Drezdzon, John Wiley & Sons, 1986, incorporated herein by reference.

The silyl hydride groups on the solid surface are then reacted with a metal salt solution containing an amount of metal sufficient to react with a desired amount of the silyl hydride groups to reduce the metal ions in solution to a valence of zero to deposit metal on the surface of the substrate. Each silyl hydride moiety serves as a one electron reducing site. This self limiting reaction yields an ultra thin metal layer, one metal atom thick, on the substrate surface.

The metal ions may be of any suitable type that are soluble in water or an appropriate organic solvent and capable of being reduced by silyl hydride functions. The metal ions are preferably furnished by a salt thereof. Suitable metal ions may be furnished by the salts of silver, gold, mercury, lead, uranium, palladium, platinum, copper, bismuth, osmium, ruthenium, antimony and tin and the like. For example, silver is preferably furnished by silver nitrate.

The metal ions are preferably in an aqueous solution. While water is preferred, other solvents such as organic solvents including methanol, ethanol, and propanol or mixtures thereof can be used. When an organic solvent is used with water, it should result in a miscible solution or carrier for the metal ions.

In the reaction of the silyl hydride groups with the metal ions, the temperature is preferably room temperature, i.e. 25° C., although if required or desired, the temperature can be about 40 or 50 up to about 100° C. The time of reaction is from almost immediate, about 30 seconds to 1 minute up to about 24 to 48 or more hours, and preferably about 20 to 30 hours.

For a more detailed discussion of a suitable process for depositing a first monatomic metal layer on a substrate reference is made to U.S. Pat. No. 5,281,440, incorporated herein by reference.

In accordance with the electroless deposition process, the activated substrate surface having a monatomic metal layer is then immersed in a bath including a chemical reducing agent, metal ions and optional additives and organic acids in accordance with established procedures of electroless plating well known in the art to build up the homogeneous metal coating. The monatomic metal layer acts as an attractant for the deposition of metals by electroless plating thereby selectively depositing the metal layers only on the monatomic metal layer instead of indiscriminately depositing the metal layers over the entire substrate surface that is immersed in the bath.

The chemical reducing agent may be selected from hypophosphite, formaldehyde, hydrazine, borohydride, amine boranes and the like, and mixtures thereof.

The homogeneous metal coating may be formed of one or more homogeneous metal layers. The metal layers may be of the same metal or of different metals such as nickel, copper, cobalt, palladium, platinum, gold and the like. The homogeneous metal coating is formed from most any suitable metal ions contained in the bath and forming the homogeneous metal coating. In a preferred embodiment, the homogeneous metal coating is formed from salts of nickel, copper, cobalt, palladium, platinum, gold and other metals well known in the art of electroless plating.

The optional additives and organic acid are added to increase the rate of deposition and/or increase the stability of the bath and act as both a buffer and mild complexing agent, respectively. The optional additives and organic acid include hydroacetic acid, sodium acetate, sodium fluoride, lactic acid, propionic acid, sodium pyrophosphate, ethylenediamine, thallous nitrate, boric acid, citric acid, hydrochloric acid, malonic acid, glycine, malic acid, mercaptobenzothiazole, sodium lauryl sulfate, lead(II) ion, sodium potassium tartrate, sodium hydroxide, sodium carbonate, ethylendiaminetetraacetic acid, mercaptobenzothiazole, methyldichlorosilane and tetrasodium ethylenediaminetetraacetic acid, sodium hydroxide and ammonia solution, sodium citrate, ammonium chloride, sodium hydroxide, ammonium sulfate, sodium lauryl sulfate, sodium succinate and sodium sulfate and the like, and mixtures thereof.

For example, for the electroless deposition of nickel, the electroless plating bath preferably contains a nickel salt such as nickel(II) chloride or nickel(II) sulfate, a chemical reducing agent such as hydrazine, borohydride and hypophosphite and an optional additive such as hydroacetic acid, sodium citrate, sodium acetate, sodium fluoride, lactic acid, propionic acid, ammonium chloride, sodium pyrophosphate, ethylenediamine, thallous nitrate, boric acid, citric acid, hydrochloric acid, malonic acid, glycine, malic acid, mercaptobenzothiazole, sodium lauryl sulfate, lead(II) ion, sodium hydroxide and ammonia solution in order to adjust the pH value. For the electroless deposition of cobalt, the electroless plating bath preferably contains a cobalt salt such as cobalt(II) chloride and cobalt(II) sulfate, a chemical reducing agent such as sodium hypophosphite and dimethylaminoborane and optional additional additives such as sodium citrate, ammonium chloride, sodium hydroxide, tetrasodium ethylenediaminetetraacetic acid, ammonium sulfate, sodium lauryl sulfate, sodium succinate and sodium sulfate. For the electroless deposition of copper, the electroless plating bath preferably contains a copper salt such as copper sulfate, a chemical reducing agent such as formaldehyde and optional additives such as sodium potassium tartrate, sodium hydroxide, sodium carbonate, mercaptobenzothiazole, methyldichlorosilane and tetrasodium ethylenediaminetetraacetic acid.

The invention will be further clarified by a consideration of the following examples, which are intended to be purely exemplary of the invention.

Referring to the examples, all moisture-sensitive reactions in accordance with one aspect of the present invention were carried out under an inert atmosphere in oven-dried glassware. Dichloromethane, pyridine, and trichlorosilane were distilled from calcium hydride under dry nitrogen. The silver nitrate was used without purification. Methanol was distilled from magnesium methoxide. All other reagents and solvents were purified according to published procedures well known in the art.

The silica gel substrates used in Examples 1–4 for the silylation reactions were both Merck Silica Gel G (BET surface=410–470 $m^2/g$) and Davisil chromatographic silica gel, 35–60 mesh, Grade 636, type 60A (BET surface area= 485 $m^2/g$).

The silica gel substrates were dried in a convection oven held at 140° C. for at least 24 hours prior to use. The dried silica gel substrates were treated with trichlorosilane in methylene chloride either with pyridine to remove the hydrogen chloride formed (Example 3) or without pyridine (Example 4) reacted and washed with dry methanol and methylene chloride prior to drying.

All $^{29}Si$ cross-polarization/magic-angle-spinning nuclear magnetic resonance spectra were obtained on a Chemagnetics CMC-200 (solids) NMR spectrometer operating at 39.73 MHz with $Me_4Si$ as an internal standard. The sweep width used was 20 kHz, contact time 5 ms, acquisition time 0.20 s, and spinning rate 5 kHz.

Infrared spectra were run on either Nicolet 60 SX or 5 DX FTIR spectrophotometers. Infrared spectra of silica gel-immobilized silyl hydrides were taken on a Nicolet 60 SX FTIR spectrometer using the diffuse reflectance infrared Fourier transformation (DRIFT) technique.

The silyl hydride groups on the substrate surface were determined by reacting the silica gel with a silver nitrate solution in a dark environment and then filtered on a B üchner funnel and washed with deionized water to remove all traces of unreacted silver nitrate. The silver nitrate solution was prepared by drying silver nitrate powder in an oven at 140° C. for 24 hours. The dry silver nitrate powder was then dissolved in deionized water to form the silver nitrate solution. The filtrate was then transferred to a volumetric flask and filled with deionized water. The solution was then used for Inductively Coupled Plasma (ICP) analysis against a commercially available silver standard. The ICP analysis was performed on a Perkin-Elmer Plasma II emission spectrometer. The amount of SiH on the substrate was then calculated as follows:

mmoles of $AgNO_3$ started with−mmoles unreacted $AgNO_3$= mmoles $AgNO_3$ consumed mmoles $AgNO_3$ consumed=mmoles SiH present/gram modified silica gel

EXAMPLE 1

Two samples of each dried silica gel substrate (50 grams) as previously described were filled into separate preweighed three-necked 1 liter round bottomed flasks equipped with an addition funnel and a Dewar condenser filled with a mixture of dry ice and 2-propanol and a mechanical stirrer. The Dewar condenser was vented through a Drierite-filled drying tube.

Trichlorosilane (15 ml) was added dropwise through the addition funnel with continuous swirling of the flask. The reaction mixture was allowed to sit for 12 hours. Afterwards, methanol (50 ml) was added to the flask at 0° C.

Separate samples of the silica gel substrate were then filtered on a Büchner funnel, washed several times with methanol and either dried on the funnel or under an aspirator vacuum at 100° C.

2.4 mmol of SiH/gram of silica gel substrate was deposited on the silica gel substrate using non-inert atmosphere techniques as determined by silver ion ICP analysis.

EXAMPLE 2

Two samples of each dried silica gel substrate (150 g) were transferred into separate preweighed three-necked 1 liter round bottomed flasks equipped with an addition funnel, gas inlet, Dewar condenser filled with a mixture of dry ice and 2-propanol and a mechanical stirrer. The equipment was oven dried and assembled while hot under an argon atmosphere as previously described above.

Anhydrous, freshly distilled dichloromethane (400 ml) was added via a double pointed stainless steel needle. Freshly distilled trichlorosilane (60 ml) was transferred into the addition funnel using the same technique as for the dichloromethane and afterwards added dropwise to the reaction mixture over a period of 60 minutes. Afterwards, the solution was stirred for an additional period of 3 hours. It was then cooled to 0° C. with an ice bath, and anhydrous, freshly distilled methanol (100 ml) was added carefully over a period of 0.5 hours. The trichlorosilane and the dichloromethane were freshly distilled from calcium hydride, the methanol was freshly distilled from magnesium methoxide, all under dry nitrogen.

The silica gel substrates were filtered on a Büchner funnel and washed several times with dry methanol. The resulting silica gel was then dried under aspirator vacuum for 8 hours at 110° C.

IR (DRIFT) spectrum, absorptions at: 2253, 2852, 2952 and 3563 $cm^{-1}$; $^{29}Si$ NMR (CP/MAS) δ−74.6 (SiH), −85.0 (SiH), −101.7 and 111.1 ppm.

2.7 mmol of SiH/gram of silica gel was deposited on the silica gel substrate using inert atmosphere techniques as determined by silver ion ICP analysis.

As shown in Examples 1 and 2, in accordance with one aspect of the present invention, the surface coverage of SiH groups, as measured as moles per gram of silica gel, increased by approximately 12% using inert atmosphere techniques in comparison to non-inert atmosphere techniques.

EXAMPLE 3

Treatment of silica gel substrate with trichlorosilane. (Method using pyridine.) One sample of each dried silica gel (40 g) was transferred into separate three-necked 3000-ml flasks equipped with a water condenser, mechanical stirrer, and an addition funnel. Freshly distilled trichlorosilane (125 ml, 1.24 mol) in 800 ml of dry $CH_2Cl_2$ was added to the silica gel under an argon atmosphere. The reaction mixture was cooled to −78° C. with dry ice and acetone. Pyridine (300 ml, 3.71 mol) was added slowly dropwise from an addition funnel to the reaction mixture of −78° C. with intermittent stirring. A thick precipitate of pyridinium chloride formed in the reaction flask. An additional 400 ml portion of dry $CH_2Cl_2$ was added to the reaction mixture, and the mixture was stirred at room temperature under argon for 24 hours. The reaction mixture was then again cooled to −78° C., and dry methanol (400 ml) was added slowly to the mixture dropwise. The reaction mixture was filtered on a B üchner funnel, and the silica gel was washed further with 1000 ml of dry methanol to dissolve and remove the pyridinium chloride precipitate. Finally, the silica gel was washed with $CH_2Cl_2$ (500 ml). The activated silica gel product was then dried at 110° C. for 8 hours under an aspirator vacuum.

The IR (DRIFT) spectrum showed absorptions at 2253, 2852, 2952, and 3563 $cm^{-1}$; $^{29}Si$ NMR (CP/MAS) δ−74.6 (SiH), −85.0 (SiH), −101.7, and 111.1 ppm.

2.0 mmol of SiH/gram of silica gel was deposited on the silica gel substrate as determined by silver ion gravimetric analysis.

EXAMPLE 4

Treatment of Silica Gel with Trichlorosilane. (Method without pyridine.) One sample of each dried silica (50 g) was transferred into separate three-necked 1000 ml flasks equipped with an addition funnel and a Dewar condenser filled with crushed dry ice in isopropyl alcohol and vented through a Drierite-filled drying tube. The silica gel was slurried by the addition of 150 ml of dry $CH_2Cl_2$ under an argon atmosphere. Freshly distilled trichlorosilane (15.2 ml, 0.151 mol) was added dropwise through the addition funnel, with hand swirling, to the $CH_2Cl_2$ slurry of silica gel over a period of approximately 30 minutes. It was then cooled to 0° C. with an ice bath, and 50 ml of anhydrous methanol was slowly added dropwise from the addition funnel with intermittent stirring over a period of 0.5 hours. The reaction mixture was filtered on a Büchner funnel and the silica gel was washed five times with 50 ml portions of dry methanol. The modified silica gel product was then dried at 110° C. for 8 hours under aspirator vacuum.

The IR (DRIFT) spectrum was essentially the same as that of the product prepared by the method using pyridine. 2.4 mmol of SiH/gram of silica gel was deposited on the silica gel substrate using inert atmosphere techniques as determined by silver ion gravimetric analysis.

Examples 3 and 4 were not performed by evacuating and refilling the reaction flask with argon or using cannula techniques. As shown in Examples 3 and 4, in accordance with another aspect of the present invention, the surface coverage of SiH groups, as measured as moles per gram of silica gel, increased by approximately 20% without the addition of pyridine as opposed to the addition of pyridine.

EXAMPLE 5

Silver nitrate crystals were crushed and the powder was dried in an oven at 140° C. for 24 hours. Dry silver nitrate (3.83 mmol, 0.65 g) was dissolved in 25 ml of double deionized water in a volumetric flask.

One gram of silica gel-immobilized silyl hydride (1.00 g) was placed in a vial and reacted with the silver nitrate solution over 24 hours in a dark environment to avoid oxidation of the silver precipitate. The solution was filtered on a Büchner funnel and the silica gel was carefully washed several times with double deionized water to remove all traces of unreacted silver nitrate. The filtrate was transferred into a 1 liter volumetric flask and filled with double deionized water. This solution was used for ICP analysis against a commercially available silver standard.

In order to determine quantitatively the number of silyl hydride groups on the surface of the glass slides of Example 8, the glass slides were treated in the dark with a 0.1 m $AgNO_3$ solution for 48 hours. Afterwards they were washed with acetone, allowed to dry and then transferred into a bath containing half concentrated nitric acid. After approximately 30 minutes, the slides were carefully washed with double deionized water in order to remove all traces of the nitric acid. The solution was then transferred to a volumetric flask and then used for ICP analysis.

The example was repeated for palladium(II) and similar results were obtained.

Example 5 is illustrative of the procedure useful for estimating the amount of silyl hydrides on the surface of various substrates.

EXAMPLE 6

Establishment of Stoichiometry of Silver Ion Reduction by Trimethoxysilane. A solution containing 0.6379 g (3.75 mmol) of silver nitrate in 50 ml of water was stirred with 0.127 ml (0.122 g=1.00 mmol) of trimethoxysilane. Immediately a dark precipitate formed. Following 24 hours of stirring, the precipitated colloidal silver metal was filtered off in a Büchner funnel. The supernatant was treated with 0.2 M HCl to cause precipitation of remaining silver ion as AgCl. After filtration onto a Büchner funnel, washing, and drying, there was obtained 0.3920 g (2.735 mmol) of AgCl precipitate. Thus, 1.02 mmol of Ag+ reacted with 1.00 mmol of trimethoxysilane.

EXAMPLE 7

General Procedure for the Quantitative Estimation of Silver Metal Deposited on the Surface of the Derivatized Silica Gel. The following procedure for the estimation of silver metal deposited on derivatized silica gel is representative. A 0.1332 g sample of silver-metalated silica gel was treated with 1.5 ml of concentrated nitric acid and diluted with 20 ml of distilled water. The original black color of the sample immediately discharged resulting in a white residue. The mixture was filtered through a Hirsch funnel under an aspirator through 595 filter paper (Schleicher and Shuell). The clear colorless filtrate was treated with 20 ml of saturated NaCl solution. The white precipitate was filtered as above. After the residue was rinsed with distilled water, the sample was dried under vacuum at 100° C. for 3 hours. There was obtained 0.0324 g of silver chloride. Thus, the original metallic silver loading was equal to 2.1 mmol of SiH/g of silica gel.

The example was repeated for palladium(II) and similar results were obtained.

EXAMPLE 8

Preparation of silane treated commercial glass slides.

The experiment was carried out using the same techniques mentioned under Example 2. All solvents and the trichlorosilane were dried and distilled as mentioned above. The glass slides were cleaned with boiling hexane and immediately used.

The glass slides were placed into a glass slide holder and then transferred into a reactor system adapted to accommodate the glass slide holder which was equipped with an addition funnel. Freshly distilled dichloromethane (400 ml) and afterwards freshly distilled trichlorosilane (35 ml) were transferred into the reactor system via a double pointed stainless steel needle. After 5 hours of reaction time the solution was drained off and freshly distilled dichloromethane (approximately 400 ml) was added through the addition funnel, after approximately 5 minutes the solvent was drained off as well. This step was repeated one more time with commercially available dichloromethane in order to wash the glass slides free of trichlorosilane before they are taken out of the reactor system.

EXAMPLE 9

General procedure for the activation of pendant hydroxy groups containing surfaces for further electroless plating.

The modified microscope slides of Example 8 were treated for approximately 5 minutes with an aqueous solution of silver nitrate, rinsed carefully with distilled water to remove all traces of unreacted silver nitrate and air dried in a dark environment to avoid exposure to light. Electroless plating was then performed using standard electroless plating baths as described in *Modern Electroplating,* F. A. Lowenheim, ed., John Wiley & Sons, Inc. New York, 1974, incorporated herein by reference.

As shown in Table 1, electroless deposits were produced of nickel, cobalt, and copper on a glass substrate. During the experiments the concentration of two of the electroless bath compounds were considerably decreased (factor: 10) and good plating rates along with very homogeneous deposits of the metals were found.

Application of the "Scotch-Tape-Test" as described in *Coatings on Glass,* H. K. Pulker, Elsevier, N.Y., 1984, incorporated herein by reference, was then performed on the microscope slides to determine the quality of the metal adhesion to the substrate. The metal deposits exhibited extremely good adhesion.

TABLE 1

| DEPOSIT | BATH COMPOSITION | COATING |
|---|---|---|
| nickel | 50 g/l $NiSO_4.6H_2O$<br>100 g/l $Na_4P_2O_7.10H_2O$<br>45 ml/l $NH_4OH$<br>3 g/l $(CH_3)_2NHBH_3$ | visually observed homogeneous coatings for separate bath compositions diluted by a factor of 1/2, 1/5 and 1/10 |
| cobalt | 25 g/l $CoSO_4.7H_2O$<br>4 g/l $(CH_3)_2NHBH_3$<br>25 g/l $C_4H_4Na_2O_4.6H_2O$<br>15 g/l $Na_2SO_4$ | visually observed homogeneous coatings for separate bath compositions diluted by a factor of 1/2, 1/5 and 1/10 |
| copper | 30 g/l $CuSO_4.5H_2O$<br>99 g/l $KNaC_4H_4O_6.4H_2O$<br>50 g/l NaOH<br>32 g/l $Na_2CO_3$<br>29 ml/l HCOOH (37%) | visually observed homogeneous coating for nondiluted bath composition |

The described activation in the foregoing examples is representative of the present invention. In addition to activation experiments some masking experiments (using normal packing tape) were performed. All areas which were not activated by silver showed no deposit of any metal during the electroless plating experiments. By using this simple technique a glass substrate may be coated with conductive lines having a width as small as 0.1 mm.

The references, publications and patents described herein are hereby incorporated by reference.

Having described presently preferred embodiments of the present invention it is to be understood that it may be otherwise embodied within the scope of the appended claims.

What is claimed is:

1. A method of electroless plating at least one homogeneous metal coating in a predetermined pattern on a substrate surface having pendant hydroxy groups, the method comprising the steps of:

a) reacting the pendant hydroxy groups of the substrate surface with a silyl hydride to form a silicon hydride bond directly on the substrate surface without any intervening bonds;

b) immersing the substrate surface of step a) in a metal ion solution to provide a monatomic metal layer in a predetermined pattern on the substrate surface; and c) immersing the activated substrate surface of step b) in a solution containing a chemical reducing agent and metal ions to build up at least one homogeneous metal coating directly only on the monatomic metal layer.

2. The method of claim 1 wherein the monatomic metal layer is of a transition metal selected from Group VIIIB or IB.

3. The method of claim 1 wherein the monatomic metal layer is selected from the group consisting of silver, gold, mercury, lead, uranium, palladium, platinum, copper, bismuth, osmium, ruthenium, antimony and tin.

4. The method of claim 1 wherein the substrate surface is selected from the group consisting of glass, silica, silica gel, titania, alumina, cellulose, ceramics, metal oxides, zeolites and alkaline earth metal oxides.

5. The method of claim 1 wherein the homogeneous metal coating is formed from salts of a metal selected from the group consisting of nickel, copper, cobalt, palladium, platinum, and gold.

6. The method of claim 1 wherein the bath further comprises metal ions and optionally additives and organic acids.

7. The method of claim 1 wherein the monatomic metal layer is provided on the substrate surface in a moisture free reaction atmosphere.

8. The method of claim 1 wherein the monatomic metal layer is provided on the substrate surface in an inert atmosphere.

9. The method of claim 1 wherein the activating step comprises:

a) reacting the hydroxy groups of the substrate surface with a silyl hydride to provide a controlled number of silyl hydride groups on the substrate surface; and then b) reacting the silyl hydride groups on the substrate surface with a metal salt solution containing an amount of metal sufficient to react with a desired amount of silyl hydride groups on the substrate surface to reduce the metal to a valence of zero to deposit metal with a valence of zero on the surface of the substrate.

10. The method of claim 9 wherein the silyl hydride is selected from the group consisting of di-chlorosilane and tri-chlorosilane.

11. The method of claim 9 wherein the substrate surface is a solid surface selected from the group consisting of glass, silica, silica gel, titania, alumina, cellulose, ceramics, metal oxides, zeolites, and alkaline earth metal oxides.

12. The method of claim 9 wherein the metal salt solution is a solution containing one or more salts of silver, gold, mercury, lead, uranium, palladium, platinum, copper, bismuth, osmium, ruthenium, antimony and tin.

13. The method of claim 9 wherein the monatomic metal layer is provided on the substrate surface in a moisture free reaction atmosphere.

14. The method of claim 9 wherein the monatomic metal layer is provided on the substrate surface in an inert atmosphere.

15. A method of removing metal ions from a solution comprising the steps of:

a) providing a substrate surface having pendant hydroxy groups;

b) reacting the hydroxy groups of the substrate surface with a silyl hydride to provide a controlled number of silyl hydride groups on the substrate surface;

c) reacting the silyl hydride groups on the substrate surface with the metal ions in a solution to reduce the metal ions to a valence of zero to deposit metal with a valence of zero on the surface of the substrate;

d) removing the substrate surface of step c) from the solution; and e) reacting the substrate surface of step d) with nitric acid to recover the metal salt in the nitrate form without adding sulfuric acid.

* * * * *